US007304232B1

(12) United States Patent
Nicholes

(10) Patent No.: US 7,304,232 B1
(45) Date of Patent: Dec. 4, 2007

(54) JOYSTICK GAIN CONTROL FOR DUAL INDEPENDENT AUDIO SIGNALS

(76) Inventor: Postell Mood Nicholes, 10 Jawbone Rd., Martinsdale, MT (US) 59053

( * ) Notice: Subject to any disclaimer, the term of this patent is extended or adjusted under 35 U.S.C. 154(b) by 76 days.

(21) Appl. No.: 11/352,132

(22) Filed: Feb. 11, 2006

(51) Int. Cl.
*G10H 1/46* (2006.01)
*G10H 3/12* (2006.01)

(52) U.S. Cl. ..... 84/741

(58) Field of Classification Search ..... 84/313, 84/741, 625, 660, 697
See application file for complete search history.

(56) References Cited

U.S. PATENT DOCUMENTS 2,746,333 A * 5/1956 Penewell ..... 84/741
3,290,424 A * 12/1966 Fender ..... 84/726
3,291,888 A * 12/1966 Meazzi et al. ..... 84/741
3,478,158 A * 11/1969 Trainor ..... 84/735
3,483,303 A * 12/1969 Warner ..... 84/728
3,544,696 A * 12/1970 Broussard ..... 84/726
3,915,048 A * 10/1975 Stich ..... 84/728
4,151,776 A * 5/1979 Stich ..... 84/728
4,193,332 A * 3/1980 Richardson ..... 84/660
4,281,573 A * 8/1981 Yarema ..... 84/741
4,305,320 A * 12/1981 Peavey ..... 84/737
4,387,621 A * 6/1983 Franzmann ..... 84/735
4,480,520 A * 11/1984 Gold ..... 84/735
4,481,854 A * 11/1984 Dugas ..... 84/736
4,516,462 A * 5/1985 Schulze ..... 84/739
4,538,035 A * 8/1985 Pool ..... 200/6 A
4,581,975 A * 4/1986 Fender ..... 84/725
4,602,547 A * 7/1986 Nyack et al. ..... 84/726
4,711,149 A * 12/1987 Starr ..... 84/742
5,105,711 A * 4/1992 Barnard ..... 84/744
5,136,918 A * 8/1992 Riboloff ..... 84/723
5,311,806 A * 5/1994 Riboloff ..... 84/728
5,313,010 A * 5/1994 Matsushima et al. ..... 84/600
5,403,970 A * 4/1995 Aoki ..... 84/626
5,591,931 A * 1/1997 Dame ..... 84/726
5,675,359 A * 10/1997 Anderson ..... 345/161
5,723,804 A * 3/1998 Replogle ..... 84/726
5,724,068 A * 3/1998 Sanchez et al. ..... 345/161
5,763,808 A * 6/1998 Thomson ..... 84/728

(Continued)

OTHER PUBLICATIONS

Rickenbacker International Corp. Rickenbacker Guitar and Bass Care & Maintenance Manual, obtained from http://www.rickenbacker.com/pdfs/manual.pdf Jan. 2006, pp. 2, 3, 5, 6.

(Continued)

*Primary Examiner*—Lincoln Donovan
*Assistant Examiner*—Andrew Millikin

(57) ABSTRACT

A joystick control (20) mounted on the body (12) of an electric guitar (11) adjacent to the customarily picked section of the strings (16) provides convenient simultaneous independent gain control of two pickup signals. A pick may be held between the thumb and first finger of the picking hand while the joystick handle assembly (23) is manipulated by any free finger or fingers of that hand. This system allows smooth, quick, easy manual selection of two independent instrument voices, alternately or simultaneously in any proportion, with minimal disturbance to the player's picking. Picking strings while varying the signals' volume levels can produce desirable timbre changes, swells, and tremolo.

A waveform polarity switch (19) optionally reverses the polarity of one pickup signal. When the signals are out of phase, the change in tone of their combined voice as the joystick travels is complex.

20 Claims, 7 Drawing Sheets

U.S. PATENT DOCUMENTS

| | | | | |
|---|---|---|---|---|
| 5,773,773 | A * | 6/1998 | McCauley et al. | 200/6 A |
| 5,780,760 | A * | 7/1998 | Riboloff | 84/726 |
| 6,011,212 | A * | 1/2000 | Rigopulos et al. | 84/667 |
| 6,040,758 | A * | 3/2000 | Sedor et al. | 338/197 |
| 6,043,422 | A * | 3/2000 | Chapman | 84/723 |
| 6,111,184 | A * | 8/2000 | Cloud et al. | 84/723 |
| 6,121,537 | A * | 9/2000 | Pawar et al. | 84/728 |
| 6,194,645 | B1 * | 2/2001 | Rose | 84/313 |
| 6,327,367 | B1 * | 12/2001 | Vercoe et al. | 381/61 |
| 6,353,169 | B1 * | 3/2002 | Juszkiewicz et al. | 84/600 |
| 6,787,690 | B1 * | 9/2004 | Celi et al. | 84/723 |
| 7,115,810 | B2 * | 10/2006 | Ambrosino | 84/742 |
| 7,208,673 | B2 * | 4/2007 | Bryce | 84/742 |
| 2003/0145715 | A1 * | 8/2003 | Wnorowski | 84/726 |
| 2004/0163529 | A1 * | 8/2004 | Hyakutake et al. | 84/737 |
| 2004/0187673 | A1 * | 9/2004 | Stevenson | 84/737 |
| 2004/0196256 | A1 * | 10/2004 | Wobbrock et al. | 345/156 |

OTHER PUBLICATIONS

Reno Kling What's Up With the Six Position Varitone Switch?, obtained from http://www.gibson.com/magazines/amplifier/1999/1/ax.html Jan. 2006, p. 1.

* cited by examiner

JOYSTICK GAIN CONTROL FOR DUAL INDEPENDENT AUDIO SIGNALS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of the Invention

This invention relates generally to electrified musical instrument control circuitry. More particularly, it relates to an improved circuit system for pickup signal gain control, and control of related tonal effects.

2. Prior Art

Stringed musical instruments have been equipped with electrical waveform information pickups since at least the early 1930s. The signal from an instrument's pickup is usually amplified, and may be electrically modified, before reaching the sound reproduction device, for example, a speaker.

Multiple pickups on a single instrument have become common. When a string is plucked, a different position of the pickup relative to the vibration nodes of the string results in different signals generated by the pickup. Modern electric guitars usually have at least two pickups: a neck pickup and a bridge pickup. Multiple pickups may feed multiple distinct outputs, or be mixed into a single output audio signal.

Gain or attenuation controls to provide variable electronic modification to pickup signal level (volume), and tone (timbre) controls to modify signal waveform shape are currently in common use in electric instrument circuitry. For analog electrical signals, gain and tone controls are often controlled by knobs located on the body of the instrument, fitted to potentiometers that modify the signal. Switches may alter which pickup signals reach the output jack. A variety of external and internal effects modules are widely available to change signal timbre. A whammy bar produces vibrato by allowing the player to manually vary the tautness of the strings. The ability to vary an instrument's voice widely and conveniently is valued by many musicians.

A player's picking hand is generally the preferred actuator of signal controls, being dexterous and sensitive enough to make small adjustments. However, common prior-art methods of controlling the modification of the electrical pickups' signals prevent easy real time changes to their settings with the pick hand while picking. Knobs, switches, and sliders operated by the picking hand all require brief interruption of picking to adjust their settings. Some currently available modules therefore use foot controls, which are cumbersome, don't move with the guitar as the musician moves, and are operated by a relatively clumsy appendage. Some effects use mouth controls, which cannot be used while the musician is singing.

Additionally, prior-art controls typically vary only one signal at a time.

Further, the player has no convenient way to get information about the current position of a control in its travel range while picking.

Still further, in instruments that have two signal output channels carrying signals from different pickups, picking while rapidly panning between them has never before now been easy.

3. Previous Related Art Referenced

Dugas, in U.S. Pat. No. 4,481,854 (Nov. 13, 1984), recognizes a joystick's ability to simultaneously and independently control two ranges of signal characteristics. One axis of a first joystick is used to select the blend of signals drawn from each of two electric instrument pickups for combination, and its other axis is used to select tone filtering applied to the combined signal. One axis of a second joystick is used to attenuate the monaural signal, and its other axis is used to create a stereo effect by panning the signal between two outputs intended for two speakers. Neither joystick can be used while picking because their locations are too far from the active picking hand's position.

Since 1960, many Rickenbacker electric guitars and electric basses, for example models 360 and 4005, have been made with two output jacks. One is a mono output jack. The second, specialized, output jack is a two-channel jack that allows separate access to tone-filtered signals from the bridge treble pickup and the neck bass pickup (or neck and middle pickups as one channel in three-pickup models). It is designed to be cabled, with a two-channel stereo cable, to a separate Rickenbacker sound-control unit. When the two-channel jack is used, a knob located near the guitar's tail piece modifies the balance of the output pickup channel signals. The sound-control unit then selects and provides two signals at two monaural output jacks, allowing further independent processing of each signal.

The Rickenbacker guitars provide two attenuation control knobs not usable when the picking hand is in a normal picking position, each separately affecting one channel's signal. The balance knob is also not usable when the picking hand is in a normal picking position, and it can produce only a limited range of the attenuation combinations possible for the two channels.

Gibson also made guitars with a two-channel output jack option, for example, models ES-345 and ES-355. The newer Gibson B.B. King Lucille model has two single-signal jacks for separate access of its two channels. Gibson guitars provide multiple attenuation control knobs not usable from the picking hand's normal picking position, and each separate knob affects one pickup channel's signal.

BACKGROUND OF THE INVENTION

Advantages

Accordingly, several advantages of one or more aspects of my control system are to provide:

(a) an improved signal control for electric guitars and other electric instruments, (b) a significant reduction in the player's need to stop picking to adjust signal amplitude in musical instruments, (c) independent control of two signals in musical instruments by one movement, enabling convenient simultaneous variation of their output level, (d) a control for musical instruments which enables the picking hand to produce smooth, rapid changes between different effects provided by two differently modified signals, and (e) a joystick handle for musical instruments which can provide continuous tactile information to the player about the amount of gain to which each signal is currently subject.

Other advantages of one or more aspects of the invention are to provide for musical instruments:

a joystick control which is convenient and intuitive to use, a control which can produce a complex musical effect by rapidly and repeatedly shifting between out-of-phase signals and intermediate combinations thereof, a control circuit which is compatible with a majority of accessories and amplifiers currently in use, a control system which enables a musician to produce a substantial range of musical sounds from an electrified instrument: from familiar and common, through distinctive and unusual, to wholly novel, and a control which enhances a musician's ability to conveniently, smoothly, and rapidly shift between tonal states while picking strings, and provides desirable tonal versatility from electrified instruments having pickable strings.

Further advantages of various aspects will become apparent from a consideration of the ensuing descriptions and the accompanying drawings.

SUMMARY

In accordance with the invention, a joystick control is mounted adjacent to an electric guitar's strings near the bridge to provide rapid, easy, simultaneous independent control of two pickup signal volumes. The joystick allows real time control of two signals' levels by the free fingers of the player's picking hand. This control system lets a musician make the instrument sing alternately or simultaneously with two voices. The musician can vary the proportions of the voices, and their combined volume, while also picking the strings as desired. A waveform polarity switch optionally reverses the polarity of one pickup's signal. This setting produces a manually-controlled variable interference effect as the blend between pickups is varied.

DRAWINGS

Figures

DRAWINGS

Reference Numerals

Figure 1:
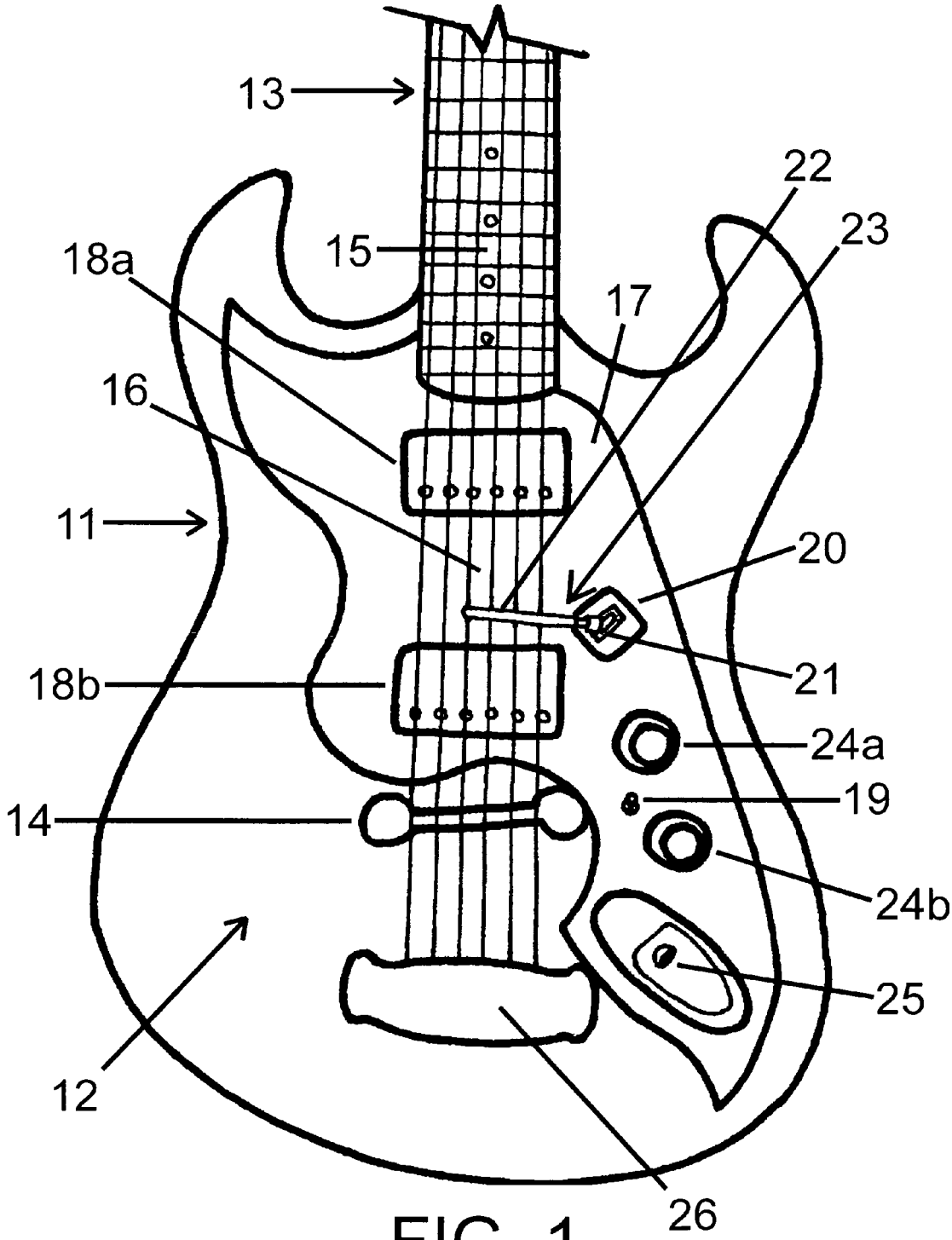
FIG. 1 is a front view of a control system for a guitar or other electric musical instrument built into a guitar body in accordance with the invention.

11 guitar
12 instrument body
13 instrument neck
14 bridge
15 strings
16 customarily picked or plucked section of the strings
17 pick guard
18*a* neck pickup (rhythm pickup)
18*b* bridge pickup (lead pickup)
19 phase switch (waveform phase switch)
20 joystick
21 joystick control handle
22 joystick handle extension
23 joystick control handle assembly (=21+22)
24*a* neck pickup's tone control
24*b* bridge pickup's tone control
25 output jack
26 tail piece
30*a* neck pickup signal input point
30*b* bridge pickup signal input point
30*c* bridge pickup phase-switched signal input point
31*a* joystick X axis input terminal
31*b* joystick Y axis input terminal
32*a* joystick X axis wiper terminal
32*b* joystick Y axis wiper terminal
33*a* neck pickup signal amplitude control potentiometer
33*b* bridge pickup signal amplitude control potentiometer
34*a* neck pickup signal amplitude control potentiometer wiper
34*b* bridge pickup signal amplitude control potentiometer wiper
35 potentiometer taper (resistance-taper) shaping resistor
36*a* neck pickup signal tone control potentiometer
36*b* bridge pickup signal tone control potentiometer
37 low-pass filter or tone waveform shaping capacitor
38*a* neck pickup signal output point
38*b* bridge pickup signal output point
39*a* (neck pickup signal) output jack tip channel
39*b* (bridge pickup signal) output jack ring channel
40 ground terminal
41*a* X rotational axis
41*b* Y rotational axis
42 joystick handle's) rotation point
43 joystick base (joystick body)
45 joystick control handle motion limit margin
50*a* neck pickup signal amplifier
50*b* bridge pickup signal amplifier
51 power source
52 (power) on/off switch
60*a* neck pickup signal analog to digital (A/D) converter
60*b* bridge pickup signal A/D converter
61 digital processor
62*a* neck pickup signal digital to analog (D/A) converter
62*b* bridge pickup signal D/A converter
63*a* neck signal digital (digitally encoded audio waveform) output jack
63*b* bridge signal digital output jack

DETAILED DESCRIPTION

Preferred Embodiment

FIG. 1

FIG. 1 supports a description of the control system layout, as integrated with a musical instrument.

FIG. 1 is a front view of an electric guitar 11, illustrating its body 12 and a portion of its neck 13. The guitar's strings 15 are supported and secured on one end by a bridge 14 and tail piece 26, and secured on the other end by a tuning head (not shown) in a manner well known in the art. Section 16 of the strings is customarily picked or plucked by a musician or player.

Further, FIG. 1 shows a layout of a pick guard 17, a neck pickup 18*a*, a bridge pickup 18*b*, a phase switch 19, a joystick 20, a neck pickup signal tone control 24*a*, and a bridge pickup signal tone control 24*b*. These are all located according to my presently preferred design.

A traditional two-channel 6.35 mm (quarter-inch) open circuit output jack 25 is provided to interface two analog electrical signals output by the signal control circuit to associated electrical equipment such as amplifiers and the like (not shown) in a well-known manner.

The joystick's control handle 21 is shown fitted with a joystick handle extension 22, which together comprise a joystick control handle assembly 23.

Guitar 11 has two magnetic audio waveform pickups 18*a* and 18*b*. The transducers comprising pickups 18*a* and 18*b* are well-known in the art. Pickups 18*a* and 18*b* are located in familiar neck pickup and bridge pickup positions, respectively.

The wiring cavity inside the guitar (not shown) is shielded electrically (not shown) to reduce unwanted hum.

Joystick 20 is mounted in guitar body 12, with its control handle 21 located adjacent to picked string section 16, near bridge 14. With guitar 11 in its normal playing posture, joystick 20 is located below picked string section 16, for convenient use by the free fingers of the musician's picking hand, those opposite the thumb.

Joystick 20 is a reasonable size for its job. In use, handle assembly 23 is held projecting between two fingers, rather than being grasped by an entire hand. Such smaller joystick units are sometimes called mini joysticks.

A double-pole, double-throw switch 19 is provided to electrically reverse the waveform from one pickup. It controls pickup 18*b*, nearest to switch 19. Switch 19 is conveniently located and easy to operate.

DETAILED DESCRIPTION

Preferred Embodiment

FIG. 2

Figure 2:
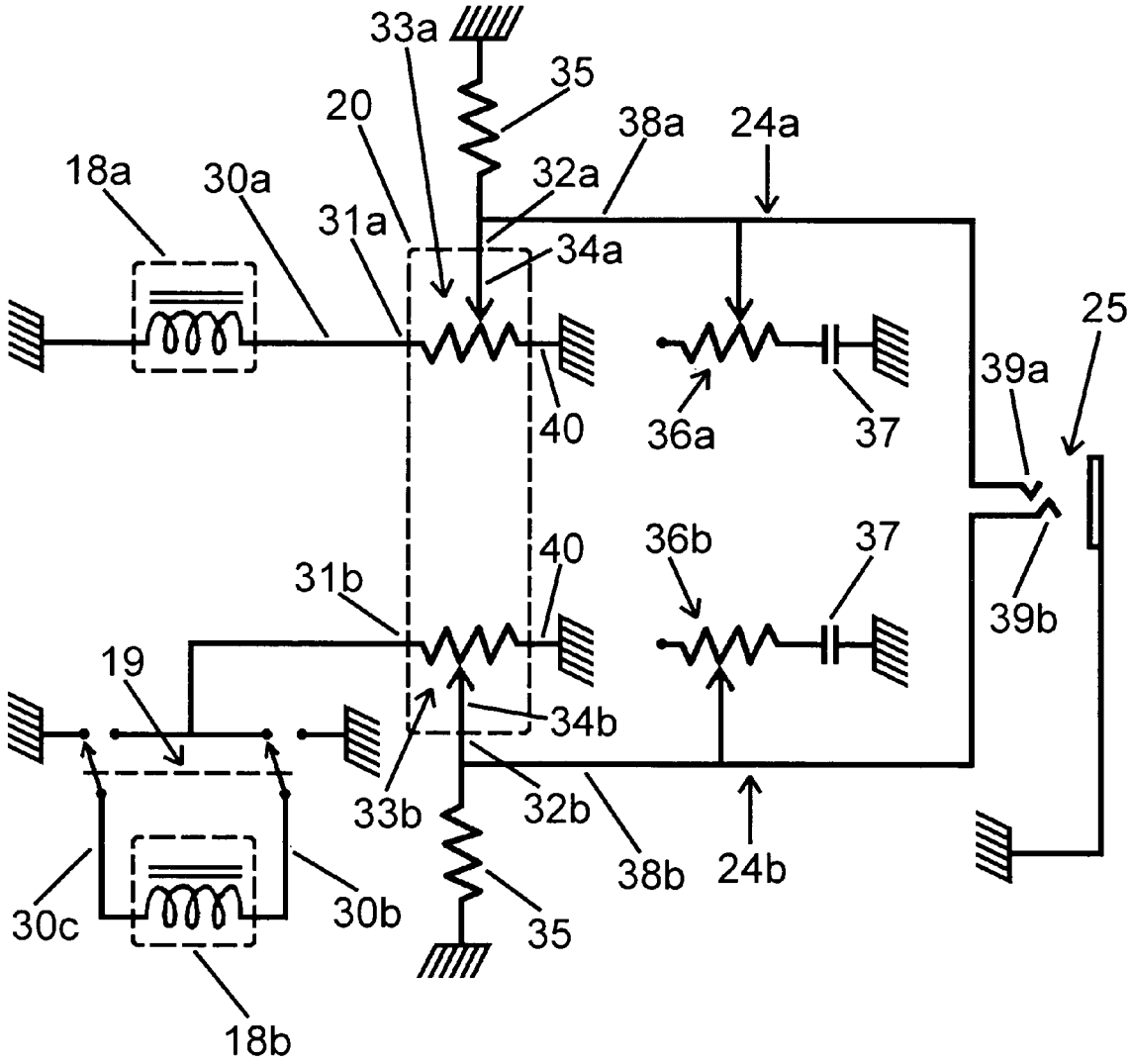
FIG. 2 is a schematic diagram of a passive analog circuit for the control system, in accordance with my presently preferred embodiment of the invention.

FIG. 2 is a schematic diagram of my presently preferred control circuit, which extends from pickups 18*a* and 18*b* to output jack 25. The audio waveform information is carried through this circuit as an analog electrical signal, typical of most electric guitars now in use.

Joystick 20 comprises two signal amplitude control potentiometers 33*a* and 33*b*, and has X and Y axis input terminals 31*a* and 31*b*, X and Y axis wiper terminals 32*a* and 32*b*, potentiometer wipers 34*a* and 34*b*, and ground terminals 40.

Amplitude control analog signal input points 30*a* and 30*b* are connected to input terminals 31*a* and 31*b* of joystick 20, which passes the processed signal out wiper terminals 32*a* and 32*b* to signal output points 38*a* and 38*b*. Input point 30*c* is active when phase switch 19 is in its alternate position.

In overview, the signal from each magnetic pickup 18*a* or 18*b* is routed through one of the joystick's two potentiometers 33*a* or 33*b*, through the pickup's respective tone control 24*a* or 24*b*, to a channel 39*a* or 39*b* of output jack 25. Control handle assembly 23 operates potentiometers 33*a* and 33*b* independently and simultaneously as it is moved, enabling selective variable attenuation of the two signals.

Ideally, potentiometers 33*a* and 33*b* are logarithmically responsive electrically to the travel of joystick handle 21 across its range. This is known as an audio taper response, and is desirable due to the non-linear response of the human ear in volume perception. The goal is for the perceived volume of the combined pickups' signals to remain constant as the control handle is moved parallel to the instrument's strings, when the signals are in phase and identical amplification is provided to each signal.

However, audio taper joystick potentiometers may be difficult to obtain. An alternative configuration that adequately approximates logarithmic response is the one diagrammed in FIG. 2. Linear taper potentiometers are used for potentiometers 33*a* and 33*b*, with a taper shaping resistor 35 between each potentiometer wiper 34*a* and 34*b* and ground.

Resistor 35 should not have too low a value lest the total load (taper resistor+potentiometer resistor) load down audio signal source pickups 18*a* and 18*b* unacceptably. 10 kohms is too low. 100 kohms is about the minimum acceptable. Resistor 35 should have about ⅕ to ⅙ the resistance of the maximum resistance of joystick potentiometers 33*a* and 33*b* to provide a suitable modification of the potentiometers' response curve. Potentiometers 33*a* and 33*b* should thus have a maximum resistance of 500 kohms or more for good results in this configuration.

The circuit diagram of FIG. 2 includes potentiometer resistance taper shaping resistors 35 and their ground connections, which are omitted if joystick 20 has audio taper type potentiometers.

Timbre (tone) controls 24*a* and 24*b* attenuate high frequencies selectively and are provided, one for each pickup's signal. Standard knob potentiometers 36*a* and 36*b* of 500 kohm value are each wired through a 0.015 microfarad low-pass filter capacitor 37 to ground.

Timbre circuitry components can be situated in the circuit between pickups 18*a* and 18*b* and their attenuation controls 33*a* and 33*b*, or between controls 33*a* and 33*b* and jack 25. The effect is the same; high frequencies are bled off in the same proportion regardless of the amplitude of the waveform.

DETAILED DESCRIPTION

Preferred Embodiment

FIG. 3

Figure 3:
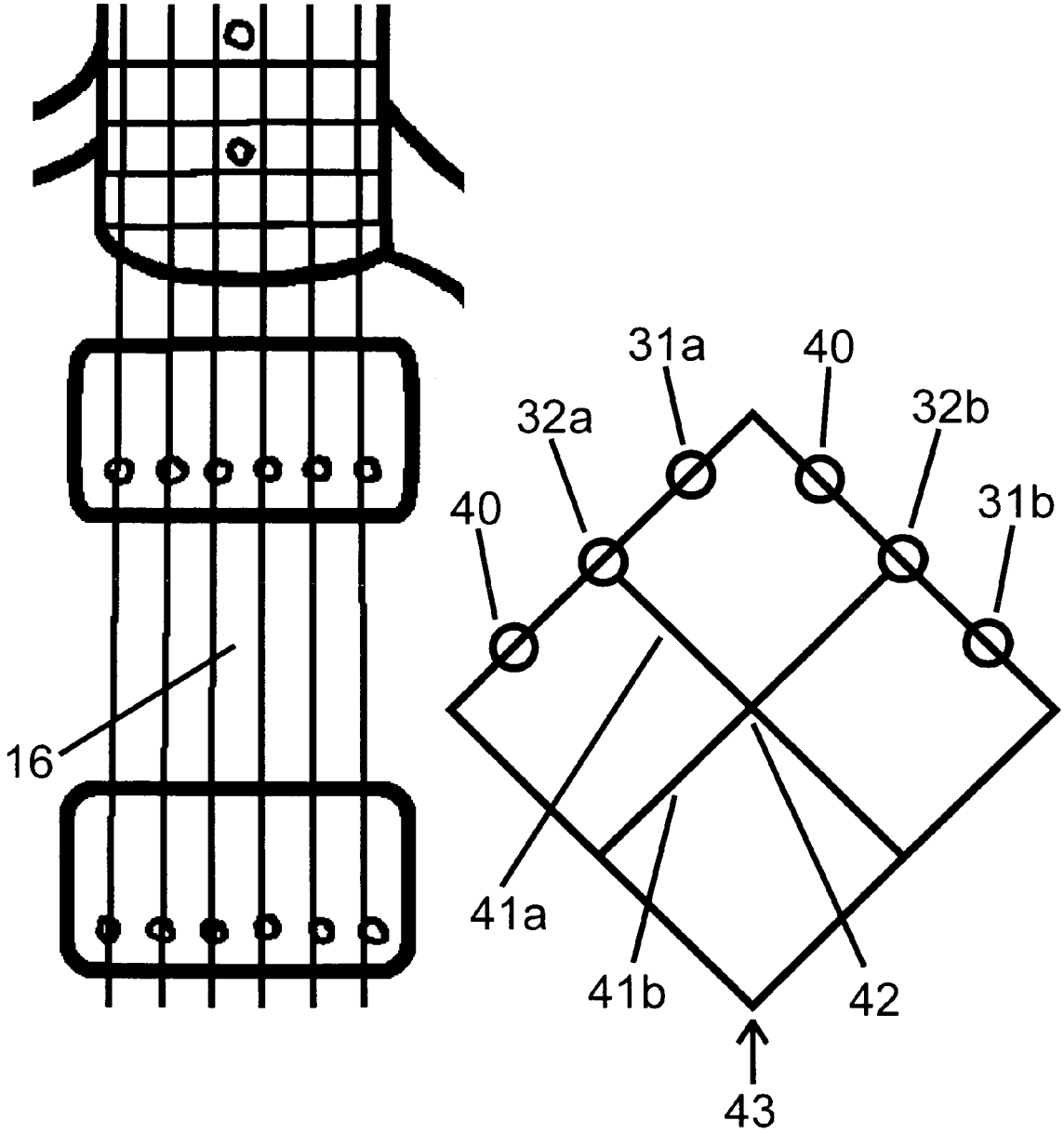
FIG. 3 is a front view diagram of the joystick's electrical connections and the joystick base's orientation on the guitar body, in accordance with my presently preferred embodiment of the invention.

X and Y axis potentiometers 33*a* and 33*b* in joystick 20 each have three electrical connections. FIG. 3 supports the installation of joystick 20.

In audio taper potentiometers, the connection points at the two ends of the potentiometer's resistive element are not equivalent, due to the resistive element's designed variation in response (non-linear taper) from end to end. According to conventional potentiometer construction, a standard audio taper potentiometer is designed with gain increasing with clockwise rotation of the actuator shaft.

This construction convention dictates that the circuit be grounded (signal fully attenuated when the wiper is at this end) at the counterclockwise end of usable travel (the wiper pivots from the bottom, therefore the left side of the top edge), as seen from the rotation actuator docking side of the potentiometer (in this case, inside the joystick) and with the three connection points aimed downward. Similarly, maximum gain (signal not attenuated) occurs at the clockwise end of usable travel, the right side of the top edge as seen from the actuator side of the potentiometer with connectors down, so the signal input point is at the right.

The actuator side of the joystick potentiometers faces the center of the joystick's base. Thus from a viewpoint on the outside of the joystick facing potentiometer 33*a* with connectors pointed down, the connection to signal input point 30*a* is made at the left-hand connector which is X axis input terminal 31*a*. The connection to signal output point 38*a* is made at the middle connector, which is X axis wiper terminal 32*a* where wiper 34*a* is attached. Ground 40 is connected at the right-hand connector.

Similarly, facing potentiometer 33*b*, the connections to signal input points 30*b* and 30*c* are made at the left-hand connector which is input terminal 31*b*, the connection to signal output point 38*b* is made at the middle connector which is wiper terminal 32*b*, and ground 40 is connected at the right-hand connector.

In linear taper potentiometers the connection points at the two ends of the potentiometer's resistive element are equivalent due to the resistive element's uniformity from end to end. In my presently preferred embodiment, the connections are arranged in the same pattern as given above for audio taper potentiometers.

FIG. 3 is a front view diagram (not to scale) of mechanical details of joystick 20 that are relevant to positioning it on guitar body 12 and connecting it as a circuit component. Joystick 20 has an X rotational axis 41*a* and a Y rotational axis 41*b* in a base (body) 43. Axes 41*a* and 41*b* are perpendicular to each other and meet under control handle 21 at a handle rotation (two-dimensional tilt) point 42.

Base 43 is mounted with X and Y rotation axes 41*a* and 41*b* oriented diagonally to picked string section 16. Axes 41*a* and 41*b* lie in a plane parallel to the plane of guitar body 12 and pick guard 17.

As diagrammed in FIG. 3, the connection terminal sides of base 43 face the neck of the guitar, positioning input terminals 31*a* and 31*b*, wiper terminals 32*a* and 32*b*, and ground terminals 40 as shown.

Joystick 20 is located close to the strings, but handle assembly 23 does not touch a string when it is tilted fully toward string section 16. Slight customization of location can accommodate individual players' hand sizes and picking styles.

DETAILED DESCRIPTION

Preferred Embodiment

FIG. 4

Figure 4:
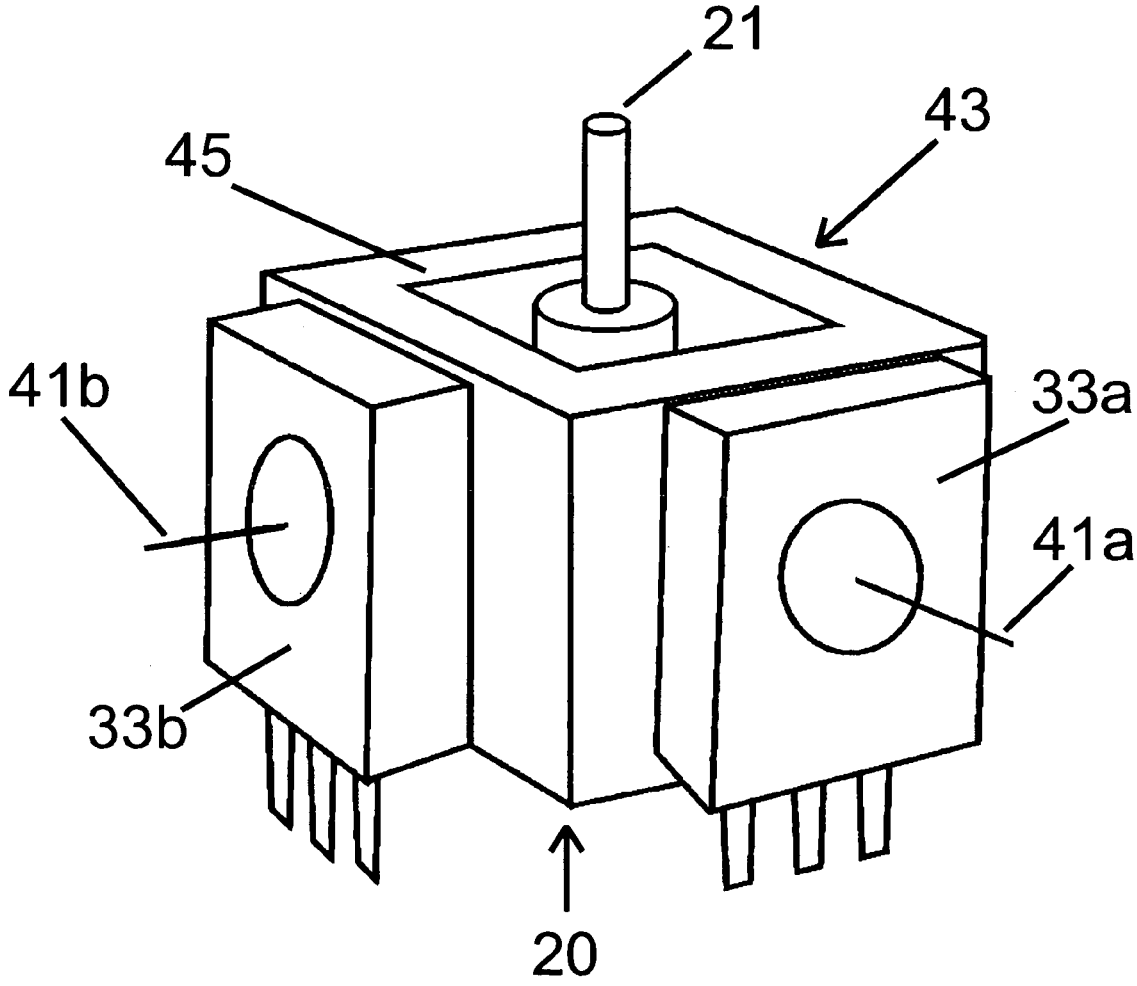
FIG. 4 is a perspective view of a joystick that has a square control handle motion limit margin, in accordance with my presently preferred embodiment of the invention.

FIG. 4 is a perspective view of joystick 20 in accordance with the invention. X and Y axes of rotation 41*a* and 41*b* are indicated. Travel of handle 21 rotates axes 41*a* and 41*b*, which position potentiometer wipers 34*a* and 34*b* in their travel, thus operating potentiometers 33*a* and 33*b*.

The base 43 contains a movable mechanism (not shown, several types are well known in the art) that allows handle 21 to tilt to any position within a motion limit margin 45 while base 43 remains fixed.

Joystick 20 has a square control handle motion limit margin 45. The square margin shape allows control handle 21 to physically reach all positions required to simultaneously control both signals independently in the complete range from fully off (zero amplitude) to fully on (full amplitude).

Base 43 can fit between the thickness or two faces of the guitar body, and within the guitar body's wiring cavity.

The mechanism of joystick 20 requires enough force to move handle assembly 23 that the unassisted force of gravity is not sufficient to move it down. However, it does not bind, stick, or resist manual operation in any direction. Joystick 20 does not self-center. Thus control handle assembly 23 remains in the position it is placed in until it is again moved by the instrument player.

Prior-art stock joysticks can be individually modified to have all of these preferred features. For example, a small joystick that does not self-center can have its margin limit increased from circular to square. Manufacturers of joysticks can produce the preferred type.

DETAILED DESCRIPTION

Preferred Embodiment

FIG. 2

The FIG. 2 schematic diagram of my presently preferred control circuit details the signal paths. The signal from neck pickup 18*a* passes through neck signal input point 30*a* of the control circuit, then through the joystick's X axis input terminal 31*a* to its associated joystick potentiometer 33*a*. Wiper 34*a* of potentiometer 33*a* is attached to the X axis wiper terminal 32*a*. Wiper terminal 32*a* is connected to both the neck pickup signal output point 38*a* and potentiometer resistance taper shaping resistor 35. (Grounding the wiper's output through resistor 35 is omitted if potentiometer 33*a* is an audio taper type.)

The signal is then affected by the neck pickup's tone control 24*a*, which consists of potentiometer 36*a* providing variable resistance to grounding the circuit through low-pass filter capacitor 37. The neck pickup signal is finally routed to tip channel 39*a* of output jack 25.

The signal from bridge pickup 18*b* normally passes through amplitude control signal input point 30*b*. When phase switch 19 is in its alternate position, the signal instead passes through alternate bridge pickup signal input point 30*c*. The signal then passes through the joystick's Y axis input terminal 31*b* to its associated joystick potentiometer 33*b*, whose wiper 34*b* is attached to the Y axis wiper terminal 32*b*. Wiper terminal 32*b* is connected to both bridge pickup signal output point 38*b* and potentiometer resistance taper shaping resistor 35. (Grounding the wiper's output through resistor 35 is omitted if potentiometer 33*b* is an audio taper type.) The signal is then affected by tone control 24*b*, which consists of potentiometer 36*b* providing variable resistance to grounding the circuit through capacitor 37. The bridge pickup signal is finally routed to ring channel 39*b* of jack 25.

Preferred Embodiment

Operation

FIG. 5,

Handle extension 22 is fitted onto control handle 21. Handle extension 22 can be a simple plastic tube slip-fit over the end of handle 21. When extension 22 is removed, the instrument may be cased without damaging the handle, joystick control, or case. When fitted in place, extension 22 provides convenient operation of joystick 20.

The guitar is cabled to a two-input amplifier via a stereo guitar instrument cable in the usual way, and the amplifier is powered up.

Figure 5:
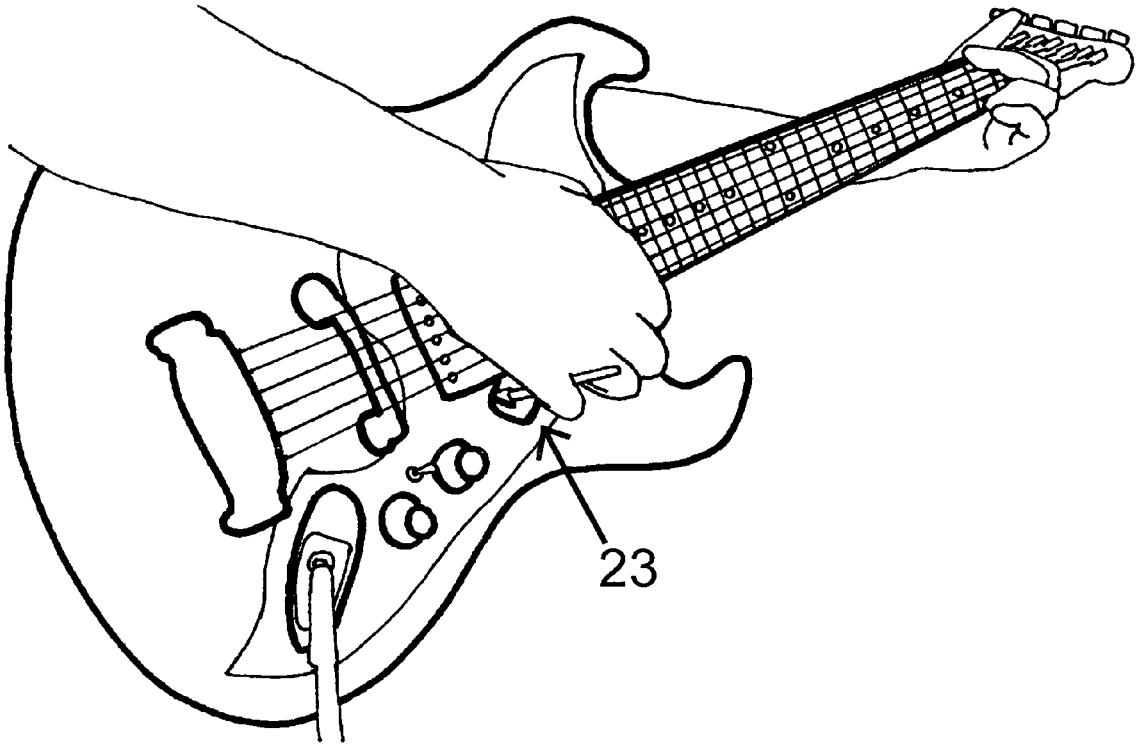
FIG. 5 illustrates a musician's picking hand in playing position holding the joystick handle assembly, in accordance with the invention.

FIG. 5 shows a picking hand posture for using the gain control system. The picking hand is in playing position while holding joystick control handle assembly 23. The pick (not shown) is held between the picking hand's thumb and first finger, and handle assembly 23 is lightly held between the third and fourth fingers of the picking hand, enabling control of each pickup's output while picking.

The player tilts handle assembly 23 to change the pickup signals' attenuation. This may be accomplished by simple linear movements of the picking hand in a plane parallel to the plane of guitar body 12 and pick guard 17.

Joystick 20 controls pickup signal output level in the following pattern:

When handle assembly 23 is tilted directly toward the closest point of string section 16 both pickup signals are fully attenuated. Each wiper 34*a* and 34*b* has traveled fully toward grounded end of its potentiometer's resistive element.

When handle assembly 23 is tilted directly away from string section 16, full output is provided from both pickups 18*a* and 18*b*. Wipers 34*a* and 34*b* are both at the signal input point end of their respective potentiometer's resistive elements.

A tilt of handle assembly 23 parallel to the line of the strings toward neck 13 provides full output from neck pickup 18*a* and fully attenuates the bridge pickup signal. The neck pickup signal's wiper 34*a* is at the signal input end of the resistive element of potentiometer 33*a*. Wiper 34*b* is at the grounded end of the resistive element of potentiometer 33*b*.

A tilt of handle assembly 23 parallel to the line of the strings toward bridge 14 provides full output from bridge pickup 18*b* and fully attenuates the neck pickup signal. The bridge pickup signal's wiper 34*b* is at the signal input end of the resistive element of potentiometer 33*b*, and wiper 34*a* is at the grounded end of the resistive element of potentiometer 33*a*.

The player can repeatedly vary the instrument's combined voice tone between two available voices, fluidly and at any desired rate, by oscillating the joystick parallel to the strings when the individual signals have different tones. This tone difference can happen in many ways, including:

a) the two pickups may be different electronically, or b) the pickups' different positions in relation to string vibration nodes may give them different output signals, or c) control circuit tone controls for the two signals may be set to different effects, or d) dual output signals may each be modified by a different external effect.

When one waveform signal is switched to be out of phase with the other, the combined voice tone is different from either voice alone due to waveform interference and cancellation, causing the change in tone as the joystick moves to be more complex.

First Additional Embodiment

Description

FIG. 6

Figure 6:
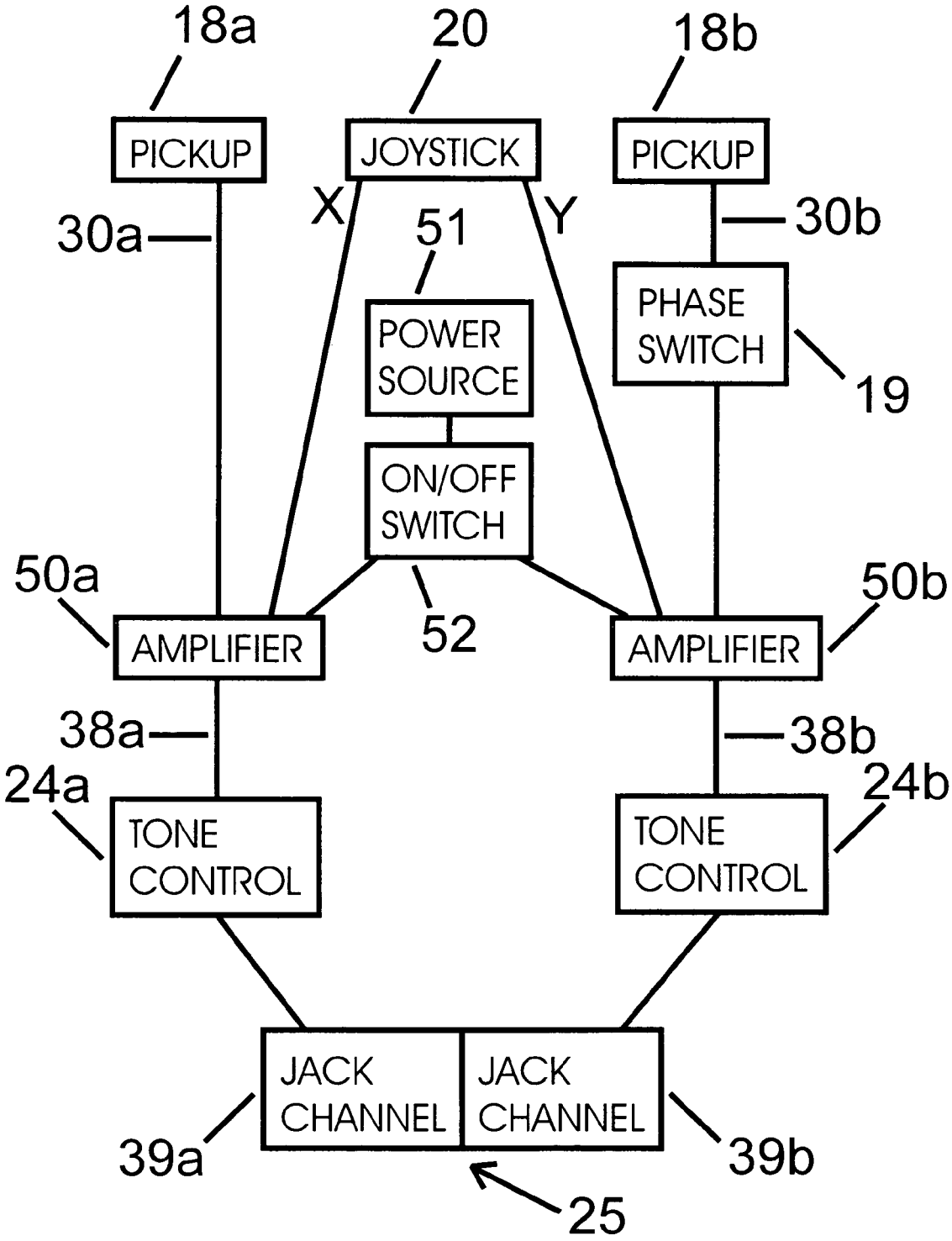
FIG. 6 is a block diagram of an active analog circuit for the control system, in accordance with the invention, the first alternative embodiment of the control system.

My presently preferred embodiment of the control system, described above, has passive (unpowered) analog signal circuitry. FIG. 6 is a block diagram of an active (powered) analog-signal circuit for an alternative embodiment of the system. A power source 51, enabled by a power on/off switch 52, drives two amplifiers 50*a* and 50*b* whose gain is controlled by the X and Y axis rotation positions of joystick 20.

The signal from neck pickup 18*a* passes through amplitude control analog signal input point 30*a*, is processed by amplifier 50*a*, passes through signal output point 38*a* and tone control 24*a*, and proceeds to tip channel 39*a* of output jack 25.

The signal from bridge pickup 18*b* passes through amplitude control analog signal input point 30*b*, and may have its waveform electrically reversed by phase switch 19. The signal is then processed by amplifier 50*b*, passes through signal output point 38*b* and tone control 24*b*, and is output at ring channel 39*b* of jack 25.

This variation can provide higher voltage output from the instrument. Feeding a higher voltage into an amplifier's input can produce overload distortion from the amplifier that some musicians find desirable. This embodiment can have an additional control to set the guitar's maximum output voltage higher or lower. The need for power adds complexity to this system's use.

First Additional Embodiment

Operation

Attach the instrument to its power source. For example, insert batteries. Turn it on. The basic functions of the active analog embodiment are operable in a similar manner to the operation of my presently preferred passive analog circuit embodiment described above. When the playing session is over, turn it off.

Second Additional Embodiment

Description

FIG. 7

Figure 7:
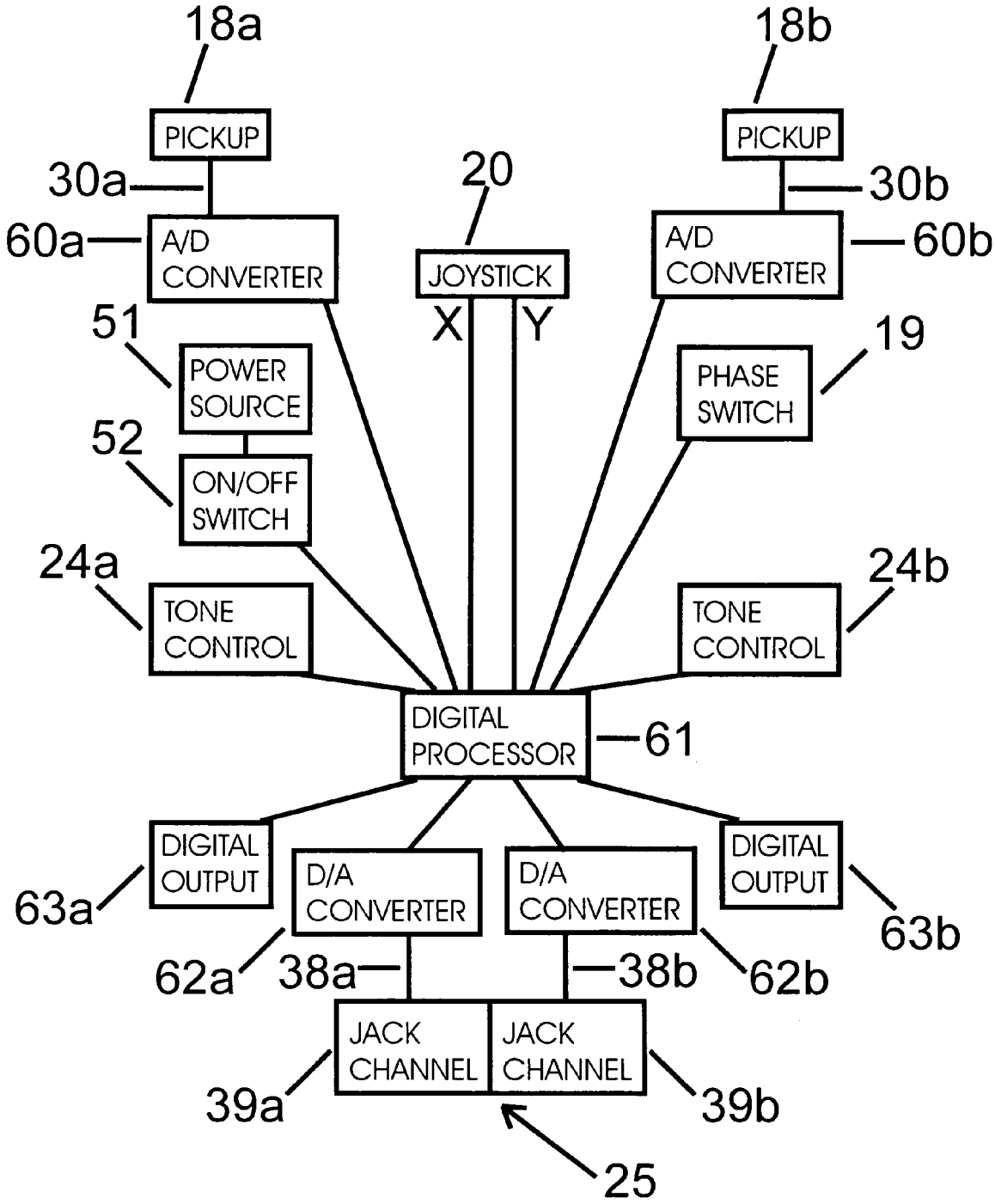
FIG. 7 is a block diagram of a digital circuit for the control system in accordance with the invention, the second alternative embodiment of the control system.

FIG. 7 is a block diagram of a digital-signal circuit for a further alternative embodiment of the control system. The pickups' signals are converted from analog to digital encoding before processing, so the position of joystick control handle assembly 23 must be able to correspondingly vary the digital data that encodes waveform amplitude.

Like the analog embodiments, the digital-signal joystick gain control system is built into a solid-body electric guitar 11 that has two magnetic audio waveform pickups located in normal neck pickup 18*a* and bridge pickup 18*b* positions. The wiring cavity (not shown) of the guitar is shielded electrically (not shown).

Analog-to-digital audio signal conversion occurs before the data streams enter the signal amplitude control device. The signal from neck pickup 18*a* passes through amplitude control analog signal input point 30*a*, and is then converted from analog to digital encoding by A/D (analog to digital) converter 60*a*. The signal from bridge pickup 18*b* passes through amplitude control analog signal input point 30*b*, and is converted from analog to digital encoding by A/D converter 60*b*.

A digital processor 61, also known as a central processing unit (CPU), receives and analyzes a) the streams of digitally-encoded waveform data from converters 60*a* and 60*b*, b) digitized X axis 41*a* and Y axis 41*b* rotation position information from joystick 20, c) digitized rotation position information from tone controls 24*a* and 24*b*, and d) digitized state (off/on) information from phase control switch 19.

Processor 61 is powered by a power source 51 enabled by an on/off switch 52, and follows a stored program.

Processor 61 modifies the data stream amplitude information it receives from A/D converter 60*a* according to the current joystick axis 41*a* rotation position information. It modifies the waveform shape information according to rotation position information from tone control 24*a*. It generates an appropriate output data stream encoding the audio waveform for presentation at digital signal output jack 63*a*, for use by digital (for example, MIDI) recording, amplification and/or signal processing equipment (not shown). Processor 61 also generates a digital output data signal for conversion to an analog signal by D/A converter 62*a*. The analog signal from converter 62*a* passes through analog signal output point 38*a* and is offered at tip channel 39*a* of standard analog guitar output jack 25.

Processor 61 also analyzes the waveform data it receives from A/D converter 60*b*, and modifies the data stream's amplitude information according to the current Y joystick axis 41*b* rotation position information. It modifies the waveform shape information according to rotation position information from tone control 24*b* and on/off state information from phase control switch 19. It generates an appropriate output data stream encoding the audio waveform for presentation at digital signal output jack 63*b*. It also generates a digital output data signal for conversion to an analog signal by D/A converter 62*b*. The analog signal from converter 62*b* passes through analog signal output point 38*b* and is offered at ring channel 39*b* of analog output jack 25.

Like the active analog first additional embodiment, the digital-signal second additional embodiment can provide a higher voltage analog signal output suitable to produce amplifier overload distortion, and might have an additional control to set the guitar's maximum analog output voltage higher or lower. The digital output jacks are an additional feature that provide immediate compatibility with a large class of modern sound-processing equipment. The need for power adds complexity to this system's use.

Second Additional Embodiment

Operation

The digital embodiment of the control circuit requires a power source. Turn it on.

The digital version has a digital format (for example, MIDI) output for use with digital device inputs, for example, those found on computers and digital recording units. It also has an analog signal output jack. So, connect an output, either to an amplifier with an analog audio cable, to a digital device with a digital cable, or both.

The basic functions of the digital embodiment are operable in a similar manner to the operation of my presently preferred passive analog circuit embodiment described above. Like the active analog version, the digital variation might have an additional control to set the guitar's maximum analog signal output voltage higher or lower.

When the playing session is over, turn it off. Further, the digital processor can be programmed to shut off the power or put the circuit in a low power consumption mode, after a signal-free interval of set length.

CONCLUSION, RAMIFICATIONS, AND SCOPE

Accordingly the reader will see that, according to the invention, I have provided an audio signal control system advantageous to musicians:

A joystick dual-axis gain control, properly located for manipulation by the free fingers of the picking hand while playing proceeds, greatly reduces the need for an instrument's player to stop picking to adjust pickup output volume level. The joystick's control of two signals by one easy movement permits convenient simultaneous independent real time adjustment of the amplitude information of two instrument voices. The variation is smooth and can be slow or rapid as desired by the player.

It is much easier to produce varying timbre, swells, tremolo, and similar effects with this control system than with conventional knob or slider controls. A wider range of effects can be produced, since the player can pick strings while varying the output signals.

When two instrument output channels are used, outboard effects can be applied to each pickup's output separately, and the level and mix of the combined processed sounds will be controlled easily, in real time and while picking, by the joystick's effect on each channel's level.

When the polarity of one pickup's waveform is reversed, a complex interference and cancellation effect is produced as the blend between pickups is varied.

The position of the joystick handle provides continuous information to the player about the amount of gain each pickup's signal is currently subject to. The joystick control is intuitive to use, and does not interfere with the type of concentration necessary to the production of music.

This control system enables musicians to produce both familiar tones and novel, unusual, musically useful sounds from a stringed electric instrument.

While my above description contains many specificities, these should not be construed as limitations on the scope of the invention, but rather as an exemplification of several embodiments thereof, including my presently preferred embodiment. Many other variations may come readily to the mind of one skilled in the art, that fall within the scope of the invention as defined in the appended claims.

For example, the audio signal amplitude control system can be embodied for use with any picked or plucked stringed musical instrument that has a device for encoding audio signals for processing. Good candidates include electric bass guitar, fretless electric guitars, and electric mandolin. The mounting of the joystick must not interfere with the instrument's crucial functions. For example, a banjo, whose vibrating membrane in the picking area is important to its sound, might need to have a support bridge attached to the body's outer rim to enable mounting the joystick in a good location for successful use of the system.

The control system's audio signal inputs can be fed by any type of acoustical-electrical transducer pickups. This includes, but is not limited to, single- and dual-coil magnetic pickups, and piezoelectric pickups.

Any joystick type of suitable size that can be connected to a device to render the joystick control handle position as corresponding processing of the amplitude information of two audio signals can be considered for this application. For example, joystick handle position might be optically sensed, and the position information used to vary separate potentiometers or amplifiers.

The audio signal amplitude control system's basic features may be combined in a circuit with related audio processing abilities, such as additional controls and audio signal modifiers. A wide variety of tone controls and internal effects circuitry, replaceable specialized modules, and external effects units are possible. Many additional features can be integrated with the joystick amplitude control circuitry for modifying either audio signal, both audio signals, or a combined signal. Any type of tone or effect processing suitable for the signal stream encoding type, with any type of manipulable control (for example, switch, knob, slider, or joystick) can be added to the circuit either before or after the amplitude control.

After amplitude processing, the two output signals can be merged into one monaural output signal. When a dual-channel analog control circuit is in monaural output mode, resistors in series on each pickup's signal path are beneficial to prevent either signal's attenuation control from affecting the attenuation of the other signal. A switch may be provided to optionally combine the two output signals passed by the joystick into one monaural output signal at the normally two-channel output jack. This switch is located out of the way and protected to avoid accidental change of state. For example, a recessed switch operable with a small tool can be located near the guitar's output jack. This switch enables convenient standby compatibility with monaural guitar cables and amplifiers.

Various workable hybrid analog-digital control circuit systems are obvious to one skilled in the art.

An instrument can have more than two pickups. The control circuit can be connected to more than two pickups. A device can be provided to combine multiple available pickup signals into two signals, and/or to select two signals from those available, for joystick controlled amplitude modification of the two signals. Multiple polarity switches for multiple pickups can be provided for greater flexibility. One or both signals affected by a joystick gain control can be combined with one or more other signals before output.

An instrument can have only one pickup, whose signal is split into two signals. Then phase, gain and tone controls can be applied to each signal independently.

An additional joystick can be provided elsewhere on the instrument to control the timbre rather than the gain of each signal. An additional switch can be provided to exchange the functions of the two joystick controls, so that optionally the joystick adjacent to the strings will vary the tone of each pickup.

In one prototype, the joystick controls were connected in such a way that when controlling timbre:

The joystick handle tilted toward the strings maximally attenuates the high frequencies of both pickups.

The joystick handle tilted away from the strings provides full frequency range output from both pickups.

The joystick handle tilted parallel to the strings toward the neck pickup provides full frequency range output from the neck pickup and maximally attenuates the high frequencies of only the bridge pickup.

The joystick handle tilted parallel to the strings toward the bridge pickup provides full frequency range output from the bridge pickup and maximally attenuates the high frequencies of only the neck pickup.

Circuit components can be provided in kit form for fitting or retrofitting an instrument with the joystick gain control system.

The circuit can be specially constructed for protracted heavy use, such as socketing components for easy replacement and servicing.

The joystick control handle extension can mate with a threaded section of the control handle. A collapsible handle can replace the removable control handle extension. Also possible is a joystick handle long enough for convenient use that does not have a removable or collapsible section.

The joystick can be either temporarily or permanently mounted to the body of the instrument. Control handle position signals can be passed wirelessly (for example, by radio or light waves) to a circuit portion not mounted in the instrument. The externally located portion of the circuit can receive dual signals from the instrument's standard two-channel output jack via a standard stereo output cable, and the joystick's position affects the two signals' amplitudes as described. This permits use of a joystick gain control system without modifying an instrument's existing wiring.

An attachable/detachable joystick control unit that includes an output jack can be mounted in the preferred location by the bridge by suction cups, hook-and-loop fasteners, or some other device. The guitar's standard two-channel electrical output might be routed through it via a short stereo guitar cable from the guitar's normal output jack. This permits use of a joystick gain control system without modifying the instrument.

Further variations of this control system are:

The joystick can be one constructed with a circular joystick handle motion limit. The circular limit causes some control positions to be redundant, or renders unavailable some combinations of positions, or requires inconsistency in the gain control response to determined amounts of handle travel within the travel area.

A multi-axis control apparatus can be provided for simultaneous control of 3 or more pickups. Joysticks with a rotational or pressure-sensitive Z-axis in addition to the 2 planar X-Y axes are found in prior art.

The combined output of one joystick control unit can be routed into an input of another similar control. This increases the number of pickups that can be individually controlled.

Devices other than a joystick can be used for real time control of single or multiple pickup output by the picking hand. For example, Theremin(TM)-type technology might sense hand position. Or, a specialized sensor or receiver might read the position of an illuminated, reflective, or dense object, or a transmitter, mounted on a finger ring worn on the picking hand.

Accordingly, the scope of the invention should be determined not by the embodiments illustrated and described, but by the appended claims and their legal equivalents.

I claim:

1. A method for simultaneously controlling the waveform amplitude information of two independent audio signals, comprising the steps of:

a. providing two audio signal inputs originating from a multiplicity of acoustical-electrical transducer pickups that are incorporated into a picked or plucked stringed musical instrument, said two signals being different, and b. providing a joystick having two or more axes, a base and a handle, said handle being movable in relation to said base within a motion limit, and said base being mounted to said instrument's body adjacent to the picked or plucked section of said instrument's strings, so that said joystick's location is more particularly described as:

i) beside the strings on the side of the body that hangs downward when the guitar is in a suspended playing position, and ii) far enough away from the strings that the handle is not blocked by the nearest string when tilted fully toward it within said motion limit, and iii) close enough to the strings that a player's picking hand can move the handle to any position within said motion limit while picking strings, and iv) approximately midway between the string bridge and the body end of the neck along an axis parallel to the strings that passes through the joystick body, and c. providing a translation means for translating the position of said joystick handle in relation to said joystick base as corresponding independent modifications of the waveform amplitude information of said individual input signals to provide two resultant independent signals, whereby the waveform amplitudes of said resultant two audio signals are independently modified, and may be simultaneously varied, by moving said joystick handle.

2. The method for controlling waveform amplitude information according to claim 1, further including providing a switch for reversing the waveform phase information of one of said input signals.

3. The method for controlling waveform amplitude information according to claim 1, further including providing a stabilizing means for causing said joystick handle to retain its position in relation to said base unless urged to move.

4. A method for controlling waveform amplitude information according to claim 1 wherein said joystick handle's motion limit is square, whereby said handle may be moved to select a setting from the full range of each of the two waveform amplitude information controllers simultaneously.

5. A method for controlling waveform amplitude information according to claim 1 wherein said two input signals are processed as analog signals, and wherein said translation means includes a passive analog circuit having one potentiometer whose wiper rotates with the X axis of said joystick to limit the amplitude of one of said analog signals, and one potentiometer whose wiper rotates with the Y axis of said joystick to independently limit the amplitude of the other of said analog signals.

6. A method for controlling waveform amplitude information according to claim 1 wherein said two input signals are processed as analog signals, and wherein said translation means includes an active analog circuit comprising two amplifiers having adjustable gain, wherein one of said amplifiers processes one of said signals and the other said amplifier processes the other said signal, and further providing a second translation means for expressing said joystick's X and Y axis rotation positions as amplifier gain settings, whereby as said joystick handle is moved, each amplifier's gain processing may be correspondingly independently varied according to the rotation position of its respective joystick axis.

7. A method for controlling waveform amplitude information according to claim 1 wherein said two input audio signals are processed as digitally encoded signals, and wherein said translation means includes a digital processor, which accepts waveform information from said two signals, and also accepts said joystick's X and Y axis rotation position information, and processes said waveform information and said axis position information according to a predetermined program for expressing the axis positions as signal amplitude information alterations, whereby as said joystick handle is moved in relation to said joystick base, the amplitude information of each of said signals may be correspondingly independently varied according to the rotation position of its respective joystick axis.

8. An audio signal waveform amplitude information control system comprising:

a. a musical instrument having a body, neck, bridge and strings, said instrument being of a type that is picked or plucked, b. a multiplicity of acoustical-electrical transducer pickups providing waveform information signals, said pickups being mounted on said instrument such that one pickup, the neck pickup, is mounted closer to said instrument's neck and one pickup, the bridge pickup, is mounted closer to said instrument's bridge, c. two waveform information signal input points passing two different audio input signals originating from said pickups, d. an amplitude control means for individually modifying waveform amplitude information of said two input signals carried by said input points, e. a joystick suitable in size to be used by a player while picking, said joystick having two or more axes, a base and a handle, said handle being movable in relation to said base within a motion limit, and said base being mounted to said instrument's body adjacent to the picked or plucked section of said instrument's strings, so that said joystick's location is more particularly described as:

i) beside the strings on the side of the body that hangs downward when the guitar is in a suspended playing position, and ii) far enough away from the strings that the handle is not blocked by the nearest string when tilted fully toward it within said motion limit, and iii) close enough to the strings that a player's picking hand can move the handle to any position within said motion limit while picking strings, and iv) approximately midway between the string bridge and the body end of the neck along an axis parallel to the strings that passes through the joystick body, and f. one or more waveform information signal output points, and g. a translation means for causing the waveform amplitude information of individual signals passing from said signal input points to said signal output points to be correspondingly varied as said joystick handle is moved in relation to said joystick base, whereby the amplitude information of each of said signals is independently modified according to the rotation position of its respective joystick axis, and said signals' amplitude information may be simultaneously varied by moving said joystick handle.

9. The control system according to claim 8, further including a switch for reversing the waveform phase information of one of said input signals.

10. The control system according to claim 8, further including a stabilizing means for causing said joystick handle to retain its position in relation to said base unless urged to move.

11. A control system according to claim 8 wherein said joystick handle's motion limit is square, whereby said handle may, by rotating said joystick's X and Y axes, select settings from the full range of each of two waveform amplitude information controllers simultaneously.

12. A control system according to claim 8 wherein said input signals are processed as analog signals, and said translation means includes a passive analog circuit having one potentiometer whose wiper rotates with the X axis of said joystick limiting the amplitude of one said analog signal, and one potentiometer whose wiper rotates with the Y axis of said joystick limiting the amplitude of the other said analog signal.

13. A control system according to claim 8 wherein said input signals are processed as analog signals, and wherein said translation means includes an active analog circuit that comprises two amplifiers having adjustable gain, and wherein one of said amplifiers processes one of said signals and the other said amplifier processes the other said signal, and further including a second translation means for expressing said joystick handle's position as amplifier gain settings, whereby as said joystick handle is moved, each amplifier's gain processing is correspondingly independently varied according to the rotation position of its respective joystick axis.

14. A control system according to claim 8 wherein said audio input signals are processed as digitally encoded signals, and wherein said translation means includes a digital processor, which accepts waveform information from said signals, and also accepts said joystick's X and Y axis rotation position information, and processes said waveform information and axis position information according to a predetermined program for expressing said axis positions as waveform amplitude information alterations, whereby as said joystick handle is moved in relation to said joystick base, said signals' amplitude information may be correspondingly independently varied according to the rotation position of their respective joystick axes.

15. An audio signal waveform amplitude information control circuit comprising:

a. two audio signal input points passing two differing waveform information signals into the circuit, b. one or more waveform information signal output points passing waveform information out of the circuit, c. a joystick having two or more axes, a base and a handle, said handle being movable in relation to said base within a motion limit, and said joystick suitable in size to be positioned on the body of a picked or plucked stringed musical instrument within reach of a player's picking hand while picking, whereby a player can move the joystick handle to any position within said motion limit while picking strings, and d. an amplitude control means for individually modifying waveform amplitude information of said two signals carried by said input points, and e. a translation means such that as said handle is moved in relation to said base, the amplitude information of said two waveform signals passing independently from said signal input points to said signal output points may be correspondingly individually varied.

16. The control circuit according to claim 15, further including a switch to optionally reverse the waveform phase information of one signal passing into the circuit.

17. The control circuit according to claim 15, further including a stabilizing means for causing said joystick handle to retain its position in relation to said base unless urged to move.

18. A control circuit according to claim 15 wherein said joystick handle's motion limit is square, whereby said handle may, by rotating said joystick's X and Y axes, select settings from the full range of each of two waveform amplitude information controllers simultaneously.

19. The control circuit according to claim 15, further including a switch to optionally combine said output waveform information from two said signal output points into one monaural output signal.

20. The control system according to claim 8, wherein the pattern of said joystick's control is:

a. said joystick handle tilted fully toward said instrument's neck, parallel to said strings, fully selects the signal originating from said neck pickup, b. said handle tilted fully toward said instrument's bridge, parallel to said strings, fully selects the signal originating from said bridge pickup, c. said handle tilted fully toward said instrument's strings fully reduces both output waveforms' amplitude, d. said handle tilted fully away from said strings increases both output waveforms' amplitude to maximum levels, and e. intermediate positions set corresponding intermediate waveform amplitudes.

* * * * *